US009857075B2

(12) United States Patent
Lindstrom et al.

(10) Patent No.: US 9,857,075 B2
(45) Date of Patent: Jan. 2, 2018

(54) METHOD AND APPARATUS FOR COMBUSTION

(71) Applicant: REFORMTECH HEATING HOLDING AB, Kista (SE)

(72) Inventors: Bard Lindstrom, Johanneshov (SE); Sara Logdberg, Saltsjo-boo (SE); Paula Beneyto Satorres, Solna (SE); Frank Pieter Jannis De Groote, Vallentuna (SE)

(73) Assignee: REFORMTECH HEATING HOLDING AB, Kista (SE)

( * ) Notice: Subject to any disclaimer, the term of this patent is extended or adjusted under 35 U.S.C. 154(b) by 302 days.

(21) Appl. No.: 14/424,523

(22) PCT Filed: Aug. 30, 2013

(86) PCT No.: PCT/SE2013/051021
§ 371 (c)(1),
(2) Date: Feb. 27, 2015

(87) PCT Pub. No.: WO2014/035329
PCT Pub. Date: Mar. 6, 2014

(65) Prior Publication Data

US 2015/0260395 A1 Sep. 17, 2015

(30) Foreign Application Priority Data

Aug. 31, 2012 (SE) ..... 1250973

(51) Int. Cl.
*F23C 6/04* (2006.01)
*F23D 11/38* (2006.01)
(Continued)

(52) U.S. Cl.
CPC ..... *F23D 11/383* (2013.01); *F23C 6/04* (2013.01); *F23C 6/042* (2013.01); *F23C 7/004* (2013.01);
(Continued)

(58) Field of Classification Search
CPC ..... F23C 7/004; F23D 11/383
See application file for complete search history.

(56) References Cited

U.S. PATENT DOCUMENTS 2,806,517 A * 9/1957 Te Nuyl ..... F23C 3/00 110/260
2,879,836 A * 3/1959 Dumas ..... F23C 7/004 431/183
(Continued)

FOREIGN PATENT DOCUMENTS

DE 3901126 A1 7/1990

OTHER PUBLICATIONS

European search report, dated Mar. 2, 2016; Application No. 13 83 2823.
(Continued)

*Primary Examiner* — Avinash Savani
*Assistant Examiner* — Deepak Deean
(74) *Attorney, Agent, or Firm* — Young & Thompson

(57) ABSTRACT

A combustor for providing homogeneous combustion of liquid fuels includes an essentially tube shaped combustion body, including a combustion chamber having a plurality of reaction zones, one of which is an injection zone, the others being combustion zones for staged homogeneous combustion of evaporated fuel and air. A swirler, including a base and swirler elements, is configured to operate at a swirl number between 0.6-2.5 in combination with a flow constriction plate whose size is such that the ratio of the open diameter (De) of the constriction to the diameter (D) of the
(Continued)

Figure 1:
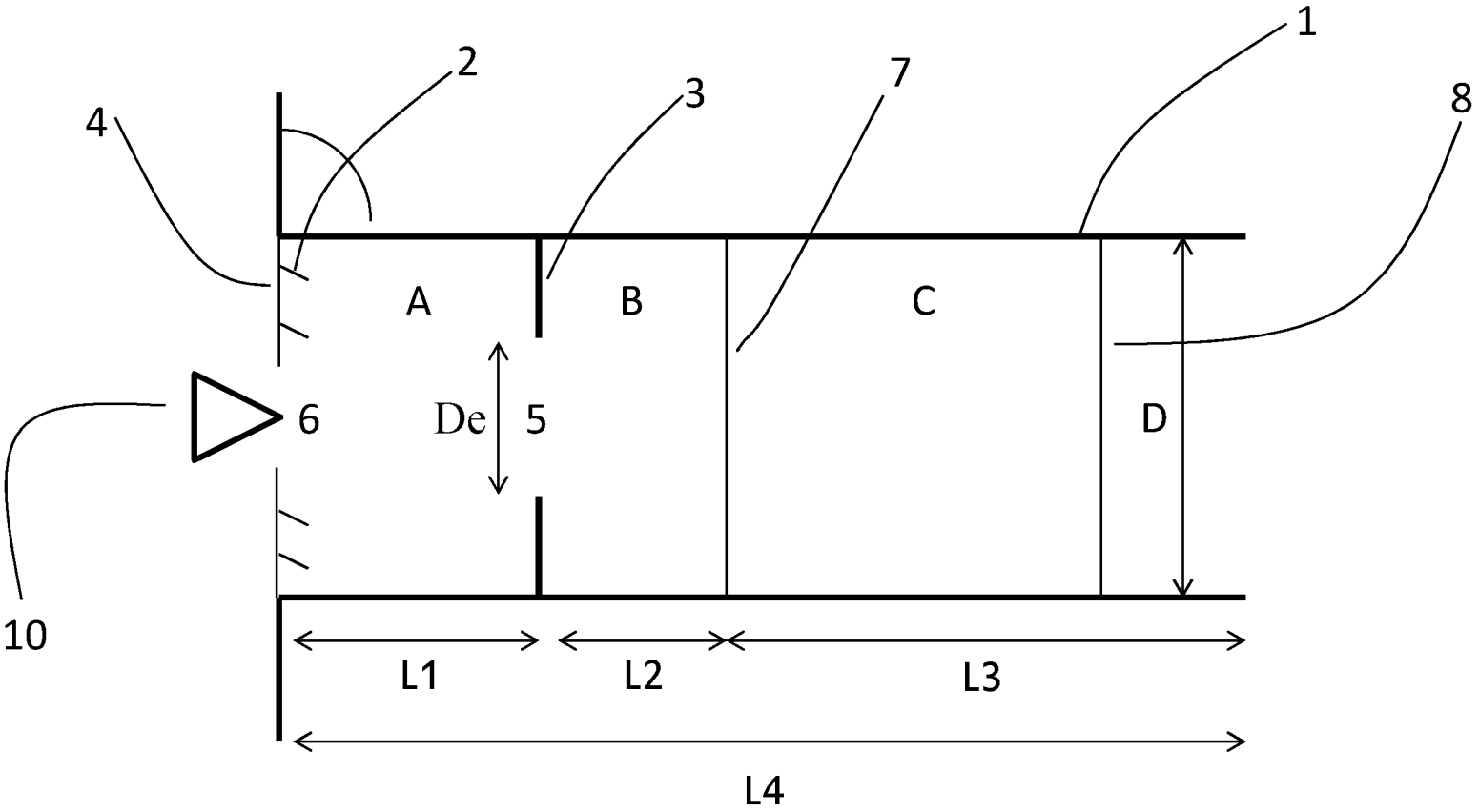

combustion body is <0.7 and the constrictor plate is placed at a distance (L1) from the base of the swirler base so that L1/De>1. A primary mixing plate is placed downstream from the constriction plate at a distance (L2) so that the ratio L2/L1<1 to allow maximum mixing of the homogeneous combustion.

8 Claims, 4 Drawing Sheets

(51) Int. Cl.

| | |
|---|---|
| ***F23C 7/00*** | (2006.01) |
| ***F23C 13/00*** | (2006.01) |
| ***F23D 11/40*** | (2006.01) |
| ***F23D 11/24*** | (2006.01) |
| ***F23D 11/42*** | (2006.01) |

(52) U.S. Cl.
CPC ..... *F23C 13/00* (2013.01); *F23D 11/24* (2013.01); *F23D 11/40* (2013.01); *F23D 11/402* (2013.01); *F23D 11/42* (2013.01)

(56) References Cited

U.S. PATENT DOCUMENTS

| | | | | | |
|---|---|---|---|---|---|
| 3,749,548 | A * | 7/1973 | Zink | F23R 3/44 | 431/115 |
| 3,886,728 | A | 6/1975 | Quinn | | |
| 4,030,875 | A * | 6/1977 | Grondahl | F23C 3/00 | 60/753 |
| 4,375,949 | A | 3/1983 | Salooja | | |
| 4,706,612 | A * | 11/1987 | Moreno | F22B 1/1861 | 122/470 |
| 4,784,600 | A * | 11/1988 | Moreno | F23C 6/04 | 431/10 |
| 4,860,695 | A * | 8/1989 | Korenberg | F22B 7/00 | 122/136 R |
| 4,989,549 | A * | 2/1991 | Korenberg | F22B 7/20 | 110/234 |
| 5,015,174 | A | 5/1991 | Dreizzler et al. | | |
| 5,131,334 | A * | 7/1992 | Monro | F23D 1/02 | 110/264 |
| 5,158,445 | A | 10/1992 | Khinkis | | |
| 5,209,187 | A | 5/1993 | Khinkis | | |
| 5,407,347 | A * | 4/1995 | Bortz | F23C 6/045 | 431/116 |
| 7,028,478 | B2 * | 4/2006 | Prentice | F23G 5/006 | 60/645 |
| 7,997,896 | B2 * | 8/2011 | Flohr | F23D 11/402 | 431/351 |
| 2005/0126755 | A1 | 6/2005 | Berry et al. | | |
| 2012/0064465 | A1 * | 3/2012 | Borissov | F23L 15/00 | 431/12 |

OTHER PUBLICATIONS

International Search Report, dated Dec. 20, 2013, from corresponding PCT application.

* cited by examiner

METHOD AND APPARATUS FOR COMBUSTION

BACKGROUND

Conventional combustors/burners of liquid fuels (like diesel and gasoline), are normally operating with a diffusion flame, in which the liquid fuel is evaporated directly during the combustion at the flame front which encapsulates the liquid fuel (usually droplets from an injector spray), resulting in high local temperatures which in turn leads to high emissions of soot and nitrous oxides (NOx), that are formed at the interface between the fuel and flame and can result in the pollution of the environment unless expensive clean-up methods are applied to the combustor.

In US-2012/064465A1, U.S. Pat. No. 3,886,728, U.S. Pat. No. 5,209,187 and U.S. Pat. No. 5,015,174 there disclosed combustion apparatuses or burners according to the state of the art at the time of filing the priority application. All of these devices comprise injection zones/injection chambers for creating swirling air.

However, none of them exhibits a combination of these features with further devices for enhancing the mixing of air and fuel, and for reducing the risk of hot spots occurring.

SUMMARY OF THE INVENTION

Thus, in view of the shortcomings of the prior art in preventing hotspots and in order to provide apparatus with enhanced mixing the inventors have devised a novel apparatus which is defined in claim 1.

In the method and apparatus according to the invention, a solution for complete evaporation and mixing of the liquid fuel with air is provided, which results in a clean homogeneous combustion of the fuel at lower temperatures and conditions that result in lower emissions and complete combustion of the fuel, including elimination of carbon monoxide through the perfect mixing of air and fuel during the combustion process.

Thereby, an essentially tube shaped combustion apparatus for providing a homogeneous combustion of liquid fuels, comprises a combustion chamber 1 having a plurality of reaction zones A, B, C, one of which is an injection mixing and evaporation zone A, the other being homogeneous combustion zones for staged homogeneous combustion of evaporated fuel and air. There is also a swirler 2, comprising a swirler base 4*a* and swirler elements 4*b*, 4*c* for mixing fuel and air configured to operate at a swirl number between 0.6-2.5 in combination with a flow constriction plate 3 where the size of the constriction is such that the ratio of the open diameter de of the constriction to the diameter d of the tube shaped combustion apparatus 1 is <0.7 and the constrictor plate 3 is placed at a distance L1 from the base of the swirler base 4*a* so that $L1/D_e>1$. A primary mixing plate 7 is placed downstream from the constriction plate 3 at a distance L2 from the constriction plate 3 so that the ratio L2/L1<1 to allow for maximum mixing of the homogeneous combustion process.

Preferably the combustion apparatus uses fuel in the form of any of diesel and gasoline.

In preferred embodiments the combustion apparatus comprises a secondary mixing plate, to reduce the total length of the reactor through increased homogenization and/or with a catalyst to operate the process under partial or complete catalytic conditions.

Suitably, the combustion apparatus is configured such that in operation the fuel pressure is at an elevated pressure of 3-20 bars to optimize the evaporation in the injection zone.

The constrictor plate 3 is preferably provided with a convex cone 9, to improve the recirculation of the combustion products into the injection zone A.

In another aspect there is provided a method of combustion, injecting liquid fuel into a first reaction zone A of a combustion chamber 1, by means of a high pressure nozzle 10 that operates in the region of 3-20 bars of over pressure, mixing the fuel with air that is continuously introduced axially to the combustion chamber 1 by a swirler 2 that produces a swirl strength in the range of 0.6-2.5; igniting the produced fuel/air mixture during start-up of the combustor with a ignition device that initially produces a conventional diffusion flame; forcing the combustion mixture diffusion flame after initial swirl mixing through a radial constriction 3 in the combustion chamber 1.

BRIEF DESCRIPTION OF THE DRAWING FIGURES

Figure 2A:
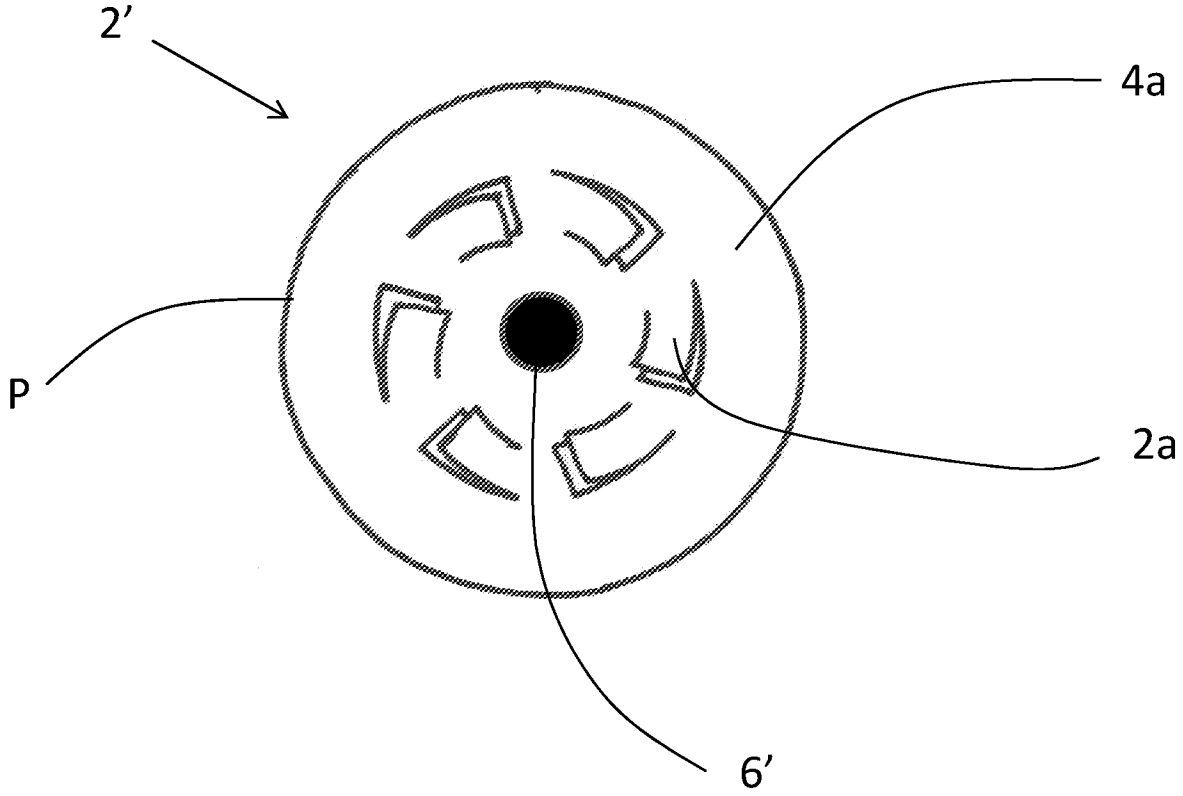
Figure 2B:
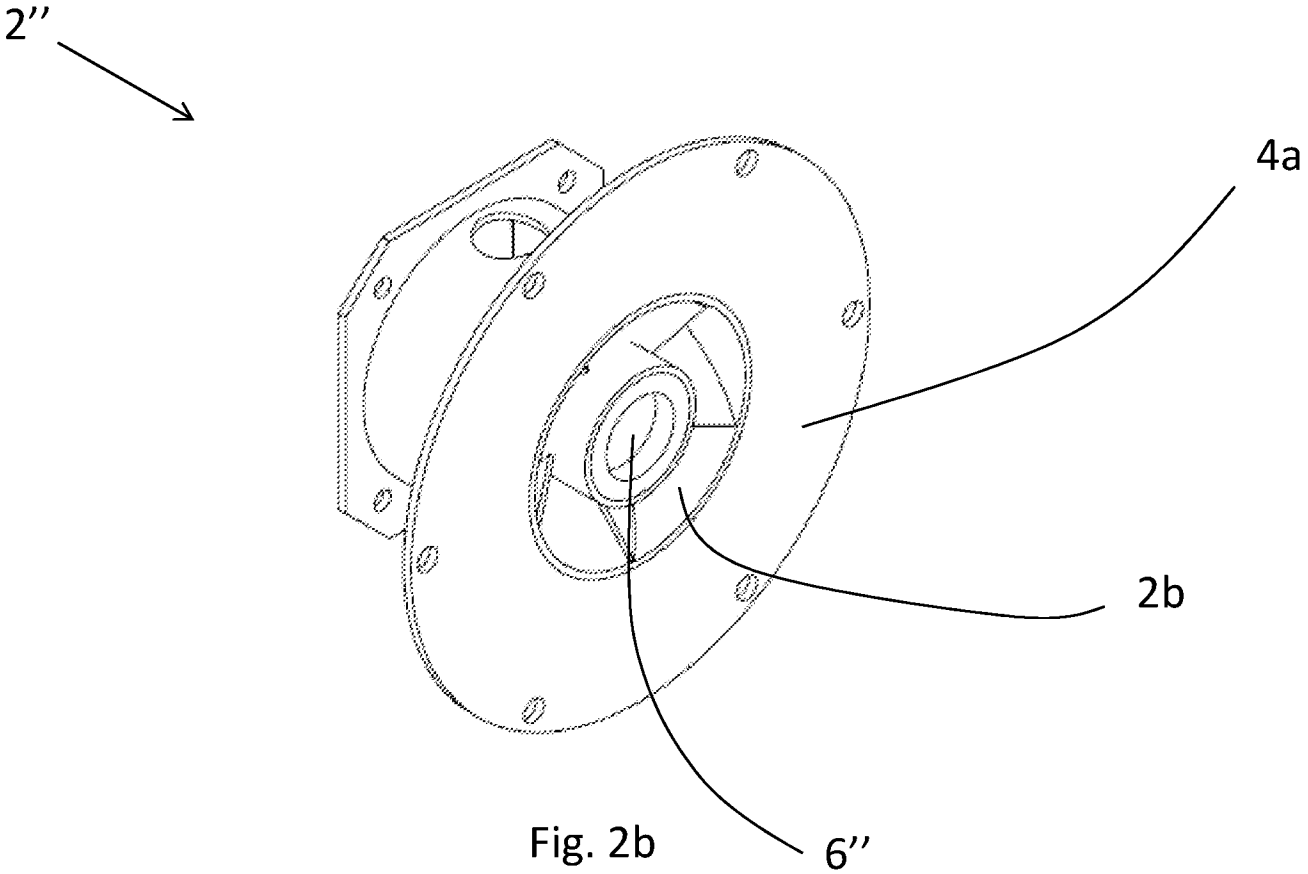

The invention will be described with reference to the attached drawings, in which FIG. 1 schematically illustrates an apparatus;

FIG. 2*a* shows a radial swirler type;

FIG. 2*b* shows an axial swirler type; and

Figure 3:
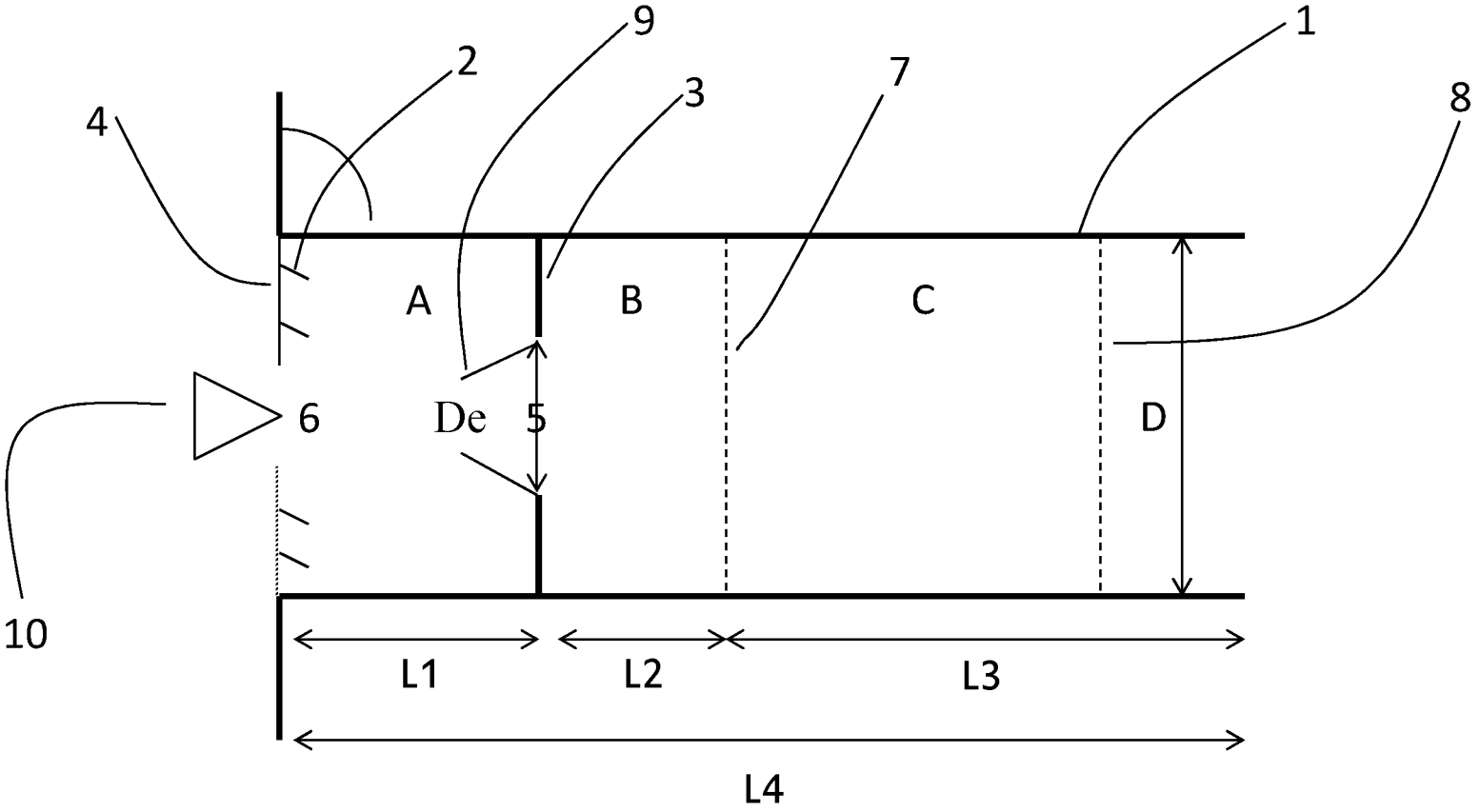

FIG. 3 shows an alternative constriction plate.

DESCRIPTION OF THE INVENTION

In one embodiment the combustion reactor 1, shown in FIG. 1, comprises a plurality, suitably three reaction zones A, B and C, in which A is the injection zone where mixing and evaporation takes place, where the fuel is injected into the combustion chamber, mixed with air while undergoing gas phase evaporation. Zone A is separated from zone B by a flow constriction plate 3 designed for recirculation of hot combustion products into the injection zone A. Zone B and C are homogeneous combustion zones separated by a mixing device 7 for staged homogeneous combustion of evaporated fuel and air.

The constrictor plate 3 is suitably provided with a convex cone 9, to improve the recirculation of the combustion products into the injection zone A.

In operation, the liquid fuel is injected into zone A of the combustion chamber 1, by means of a high pressure nozzle 10 that operates in the region of 3-20 bars of over pressure where the fuel is mixed with air that is continuously introduced axially to the combustion chamber 1 by a swirler 2, which may be of the radial or axial type, as shown in FIGS. 2*a* and 2*b*, that produces a swirl strength in the range of 0.6-2.5. Thereby, a swirler 2, comprises a swirler base 4*a*, and swirler elements 4*b*, 4*c*.

In the radial type the swirler elements 4*b* are provided as "blades" protruding inwards in the combustion chamber at an angle and disposed along a circle concentric with the periphery of the swirler base 4*a*. In the axial type the swirler elements 4*c* are provided as "blades" which are located within an inlet portion before entry into the combustion chamber."

The produced fuel/air mixture is during start-up of the combustor ignited with a conventional ignition device such as, but not limited to, a glow plug or spark plug that initially produces a conventional diffusion flame. The combustion mixture diffusion flame is after initial swirl mixing forced through a radial constriction 3 where the ratio of the open diameter of the radial constriction $D_e$ to the tube diameter D is less than 0.7 $D_e$/D<0.7 and the distance L1 between the base 4*a* of the swirler 2 and the constriction plate 3, is such so that ratio of the distance L1 and the constriction open diameter $D_e$ is greater than 1 L1/de>1.

The radial swirler 2' shown in FIG. 2*a* comprises a swirler bas plate member 4*a* with baffle like elements 2*a* arranged concentrically around a nozzle 6' at a location between the nozzle and the periphery P of the swirler 2. These baffles 2*a* are made by punching or cutting out portions in the swirler plate 4*a* corresponding to circular segments, leaving one portion of the segments attached or integral with the plate 2. This creates foldable "flaps" that can be bent upwards such they project at an angle from the plane of the swirler base plate 4*a*.

FIG. 2*b* shows an axial swirler 2"having a base plate 4*a* and deflecting elements 2*b* arranged concentrically around a nozzle 6".

There are numerous possible configurations of means for redirecting the air flow and apart from the one described one could envisage making the apertures themselves such that the bore forms an angle.

By introducing the constriction 3 described above, a negative flow zone is created at the center 5 of the combustion reactor 1 between zone A and B which enables the recirculation of hot combustion products to the fuel injection zone, providing a means for evaporating the fuel in the resulting hot gas mixture. By evaporating the fuel directly the residence time of the fuel in the reactor zone A is decreased and the as a result the combustion is "lifted" from directly above the nozzle 6 to the constriction plate 3 where a now completely pre-mixed gas phase combustion takes place, as the fuel is completely evaporated in the hot gas phase that is created from the recirculation of the hot combustion gases to the injection zone of the reactor zone A.

Additionally a primary mixing plate 7 is placed at a distance L2 from the constriction plate 3 to further increase the mixing of the combustion products and to reduce the risks of hotspot formation. The mixing plate 7 is placed at the distance L2 from the constriction plate 3 so that L2/L1<1.

In some cases a secondary mixing plate 8 can be added to the combustor 1 in order to reduce the total length L4 of the combustor 1, by further increasing the total mixing of the homogeneous combustion process. Mixing plate 8 can also be replaced by a catalyst to convert the combustor to a catalytic combustor for an optimal emission combustor.

The invention claimed is:

1. A tube shaped combustion apparatus for providing a homogeneous combustion of liquid fuels, comprising:

a combustion chamber (1) having plural reaction zones (A, B, C), one of said reaction zones being a mixing and evaporation zone (A), other ones of said plural reaction zones being zones (B, C) for staged homogeneous combustion of evaporated fuel and air, a constrictor plate (3) that separates the mixing and evaporation zone (A) from the zones (B, C) for staged homogeneous combustion of evaporated fuel and air, the constrictor plate (3) having a constriction with an open diameter (De), the constriction being a truncated cone (9) that protrudes from said constrictor plate (3) towards said nozzle (10) and into the mixing and evaporation reaction zone (A);

a primary mixing plate (7) that separates each of the zones (B, C) for staged homogeneous combustion of evaporated fuel and air from each other;

a high pressure nozzle (10) adapted to inject the fuel into the mixing and evaporation zone (A) and to mix the fuel with air which in operation is continuously introduced axially to the mixing and evaporation zone (A);

a radial swirler (2), comprising a swirler base (4*a*) and swirler elements provided as blades protruding inwards in the first reaction zone (A) at an angle and disposed along a circle concentric with the periphery of the swirler base (4*a*) for mixing fuel and air configured to operate at a swirl number between 0.6-2.5 in combination with the flow constriction plate (3) where the size of the constriction is such that the ratio of the open diameter (De) of the constriction to the diameter (D) of the tube shaped combustion apparatus (1) is <0.7, and the constrictor plate (3) is placed at a distance L1 from the swirler base (4*a*) so that L1/De>1, the primary mixing plate (7) being placed downstream from the constriction plate (3) at a distance (L2) from the constriction plate (3) so that the ratio L2/L1<1 to allow for maximum mixing in the homogeneous combustion process; and a secondary mixing plate (8) placed downstream of the primary mixing plate (7) within one of the zones (B, C) for staged homogeneous combustion of evaporated fuel and air, the secondary mixing plate (8) increasing homogenization, thereby reducing a total length of the reactor.

2. The combustion apparatus according to claim 1, wherein said mixing and evaporation zone (A) is configured to inject both diesel fuel and gasoline.

3. The combustion apparatus according to claim 1, further comprising a catalyst to operate the homogeneous combustion process under partial or complete catalytic conditions.

4. A method of combustion, comprising:

providing the tube shaped combustion apparatus of claim 1;

injecting liquid fuel into a first reaction zone (A) of a combustion chamber (1), at a pressure in a range of 3-20 bars of over pressure;

mixing the fuel with air that is continuously introduced axially to the first reaction zone (A) (1) by a swirler (2) that produces a swirl strength in the range of 0.6-2.5;

igniting the produced fuel/air mixture during start-up of the combustor with an ignition device that initially produces a conventional diffusion flame; and forcing the combustion mixture diffusion flame after initial swirl mixing through a radial constriction (3) in the combustion chamber (1).

5. The method according to claim 4, wherein, the combustion chamber is a tube-shaped combustion chamber having a tube diameter, and the following equations are satisfied:

De/D<0.7, where De is an open diameter of the radial constriction (3) and D is the tube diameter, and L1/De>1, where L1 is a distance between a base (4*a*) of the swirler (2) and the constriction plate (3), and De is the open diameter of the radial constriction (3).

6. A tube shaped combustion apparatus for providing a homogeneous combustion of liquid fuels in a homogeneous combustion process, comprising:

a tubular combustion chamber (1) having a first reaction zone (A), a second reaction zone (B), and a third reaction zone (C), each of the first, second, and third reaction zones being tubular reaction zones having a tube diameter (D), the first reaction zone (A) being a fuel mixing and evaporation zone (A), the second and third reaction zones (B, C) each being zones for staged homogeneous combustion of evaporated fuel and air, the first reaction zone (A) being located upstream of the second reaction zone (B), and the second reaction zone (B) being located upstream of the third reaction zone (C);

a constrictor plate (3) that separates the first reaction zone (A) from the second reaction zone (B), the constrictor plate (3) having a constriction with an open diameter (De) in a form of a truncated cone (9) that protrudes from said constrictor plate (3) towards said nozzle (10) and into the first reaction zone (A);

a primary perforated mixing plate (7) that separates the second reaction zone (B) from the third reaction zone (C);

a secondary perforated mixing plate (8) placed within the third reaction zone (C) for increasing total mixing of the homogeneous combustion process;

a high pressure nozzle (10) adapted to inject fuel into the first reaction zone (A); and a radial swirler (2) for mixing fuel and air, the radial swirler (2) comprising a swirler base (4*a*) and swirler blades attached to swirler base (4*a*) and protruding inwards into the first reaction zone (A) at an angle and disposed along a circle concentric with a periphery of the swirler base (4*a*), wherein the radial swirler (2) is configured to operate at a swirl number between 0.6-2.5 in combination with the flow constriction plate (3) where a ratio of the open diameter (De) of the constriction to the tube diameter (D) is <0.7, and the constrictor plate (3) is placed at a distance L1 from the swirler base (4*a*) so that L1/De>1, the primary mixing plate (7) being placed downstream from the constriction plate (3) at a distance (L2) from the constriction plate (3) so that a ratio L2/L1<1 allows for maximum mixing in the homogeneous combustion process.

7. The combustion apparatus according to claim 6, further comprising a catalyst to operate the homogeneous combustion process under catalytic conditions.

8. The combustion apparatus according to claim 6, wherein, the radial swirler (2) further comprises a swirler nozzle (6'), and the swirler blades are circular segments arranged concentrically around the swirler nozzle (6').

* * * * *